US010957997B2

(12) United States Patent
Qiao et al.

(10) Patent No.: US 10,957,997 B2
(45) Date of Patent: Mar. 23, 2021

(54) HIGH DENSITY CONNECTOR ASSEMBLY

(71) Applicant: 3M INNOVATIVE PROPERTIES COMPANY, St. Paul, MN (US)

(72) Inventors: YunLong Qiao, Singapore (SG); Saujit Bandhu, Singapore (SG); Kok Hoe Lee, Singapore (SG); Vincent Tan, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/666,497

(22) Filed: Oct. 29, 2019

(65) Prior Publication Data

US 2020/0161781 A1 May 21, 2020

Related U.S. Application Data

(60) Provisional application No. 62/769,723, filed on Nov. 20, 2018.

(51) Int. Cl.

| | |
|---|---|
| ***H01R 13/60*** | (2006.01) |
| ***H01R 12/50*** | (2011.01) |
| ***H01R 12/71*** | (2011.01) |
| ***H01R 12/70*** | (2011.01) |

(52) U.S. Cl.

CPC ..... *H01R 12/50* (2013.01); *H01R 12/707* (2013.01); *H01R 12/716* (2013.01)

(58) Field of Classification Search

CPC ... H01R 12/62; H01R 12/707; H01R 13/6335

USPC ..... 439/493, 76.1, 352

See application file for complete search history.

(56) References Cited

U.S. PATENT DOCUMENTS

| | | | | |
|---|---|---|---|---|
| 4,295,696 | A * | 10/1981 | Gray | H01R 13/5812 439/55 |
| 4,639,054 | A * | 1/1987 | Kersbergen | H01R 12/62 200/292 |
| 5,122,065 | A * | 6/1992 | Dudek | H01R 12/772 439/76.1 |
| 7,147,512 | B2 * | 12/2006 | Wu | H01R 4/027 439/607.05 |
| 7,179,117 | B2 * | 2/2007 | Wu | H01R 13/5845 439/460 |
| 7,223,915 | B2 * | 5/2007 | Hackman | H01R 13/6658 174/36 |

(Continued)

*Primary Examiner* — Neil Abrams

(74) *Attorney, Agent, or Firm* — Robert S. Moshrefzadeh

(57) ABSTRACT

A connector assembly includes, a housing, a circuit board that includes a conductive front pad and a conductive rear pad electrically connected to the front pad, and a cable that includes an insulated conductor having a conductor surrounded by an insulating material. The conductor has a diameter not greater than 24 AWG. The uninsulated front end of the conductor is terminated at the rear pad and includes a preformed bend. The connector assembly also includes a recess formed in an external surface and on a lateral side of the housing. The recess is designed to receive and house a spring member of a pull tab that is assembled to the housing. The vertical separation between the recess and the circuit board is h, the average thickness of the cable is t, and h≥3t. The preformed bend may include first and second portions connected by a substantially flattened joint.

20 Claims, 13 Drawing Sheets

(56) References Cited

U.S. PATENT DOCUMENTS

| | | | | |
|---|---|---|---|---|
| 7,297,028 | B2 * | 11/2007 | Daikuhara | G02B 6/4246 439/577 |
| 7,540,755 | B1 * | 6/2009 | Wu | H01R 13/6275 439/352 |
| 7,922,520 | B2 * | 4/2011 | Mizukami | H01R 13/65912 439/493 |
| 8,562,369 | B2 * | 10/2013 | Wu | H01R 13/6471 439/345 |
| 8,770,990 | B2 * | 7/2014 | Sytsma | H01R 9/034 439/76.1 |
| 8,926,339 | B2 * | 1/2015 | Houtz | H01R 13/5045 439/76.1 |
| 9,011,177 | B2 * | 4/2015 | Lloyd | H05K 3/222 439/607.47 |
| 9,219,333 | B2 * | 12/2015 | Wang | G02B 6/3897 |
| 9,231,393 | B2 * | 1/2016 | Buck | H02G 7/00 |
| 9,306,334 | B2 * | 4/2016 | Zhu | H05K 1/0219 |
| 9,385,466 | B2 * | 7/2016 | Henry | H01R 13/506 |
| 9,627,799 | B2 * | 4/2017 | Tseng | H01R 13/5825 |
| 9,692,187 | B2 * | 6/2017 | Qian | H01R 13/665 |
| 10,079,452 | B1 * | 9/2018 | Zhang | H01R 13/5812 |
| 10,103,453 | B2 * | 10/2018 | Pao | H01R 13/6595 |
| 10,389,068 | B2 * | 8/2019 | Leigh | H01R 24/60 |
| 2011/0306244 | A1 * | 12/2011 | Zhang | H01R 13/65914 439/624 |

* cited by examiner

HIGH DENSITY CONNECTOR ASSEMBLY

TECHNICAL FIELD

The present disclosure generally relates to connector assemblies, particularly high density connector assemblies.

BACKGROUND

Quad small form-factor pluggable (QSFP) is a widely used interface for data center external IO connection applications. As the industry is moving toward a higher data rate per cable, the quad small form-factor pluggable double density (QSFP-DD) interface has been introduced to carry double the data capacity of a QSFP cable assembly.

SUMMARY

In some cases, it may be desired to increase the data carrying capacity of a connector assembly by fitting more cables into a limited space available in the cable assembly. Since the overall size of the cable assembly interface is often standardized, it may be desired to position a higher density of cables within an available cross section space without changing the width and height of a metal shell within which a QSFP or QSFP-DD interface is provided.

Various aspects and embodiments described herein relate to a connector assembly with reduced terminal array pitch, minimized components count, and exhibiting high signal speed without compromising the signal integrity impedance matching.

An aspect of the disclosure relates to a connector assembly including a housing having top and bottom housing portions assembled to each other and defining a housing cavity therebetween. A circuit board is disposed in the housing cavity and includes an upper surface and an opposing lower surface, a front edge and a rear edge opposite the front edge. A plurality of conductive front pads is disposed on the upper and lower surfaces proximate the front edge. A plurality of conductive rear pads is disposed on the upper and lower surfaces proximate the rear edge and electrically connected to the front pads. The rear pads form first, second and third rows of rear pads disposed on the upper surface and a fourth row of rear pads disposed on the lower surface. The second row of rear pads is disposed between the first and third rows of rear pads. The first and third rows of rear pads are disposed respectively closer to and farther from the rear edge of the circuit board. The connector assembly includes first through fourth cables having a plurality of conductors. Uninsulated front ends of the conductors of the first through fourth cables terminate at the corresponding rear pads of the first through fourth rows of the rear pads, respectively. The front end of each conductor has a first preformed bend including substantially straight uninsulated first and second front end portions connected at a substantially flattened joint. The first front end portion is substantially parallel with and soldered to a corresponding rear pad. The second front end portion makes a first angle with the first front end portion greater than about 90 degrees.

Another aspect of the disclosure relates to a connector assembly including a housing. A circuit board is disposed in the housing and includes a conductive front pad proximate a front edge of the circuit board. A conductive rear pad is disposed proximate an opposite rear edge of the circuit board and is electrically connected to the front pad. A cable includes an insulated conductor having a conductor surrounded by an insulating material. An uninsulated front end of the conductor terminates at the rear pad and includes a first preformed bend having substantially straight uninsulated first and second front end portions connected at a substantially flattened joint. The first front end portion is substantially parallel with and soldered to the rear pad. The second front end portion makes a first angle with the first front end portion greater than about 90 degrees. A recess is formed in an external surface, and on a lateral side of the housing, the recess configured to receive and house a spring member of a pull tab assembled to the housing. A vertical separation between the recess and the circuit board being equal to or greater than three times an average thickness of the cable.

BRIEF DESCRIPTION OF DRAWINGS

The various aspects of the disclosure will be discussed in greater detail with reference to the accompanying figures where.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

The connector assembly according to this disclosure may be a quad small form-factor pluggable (QSFP) connector assembly. In other embodiments, the connector assembly may be a quad small form-factor pluggable double density (QSFP-DD) connector assembly.

Figure 1:
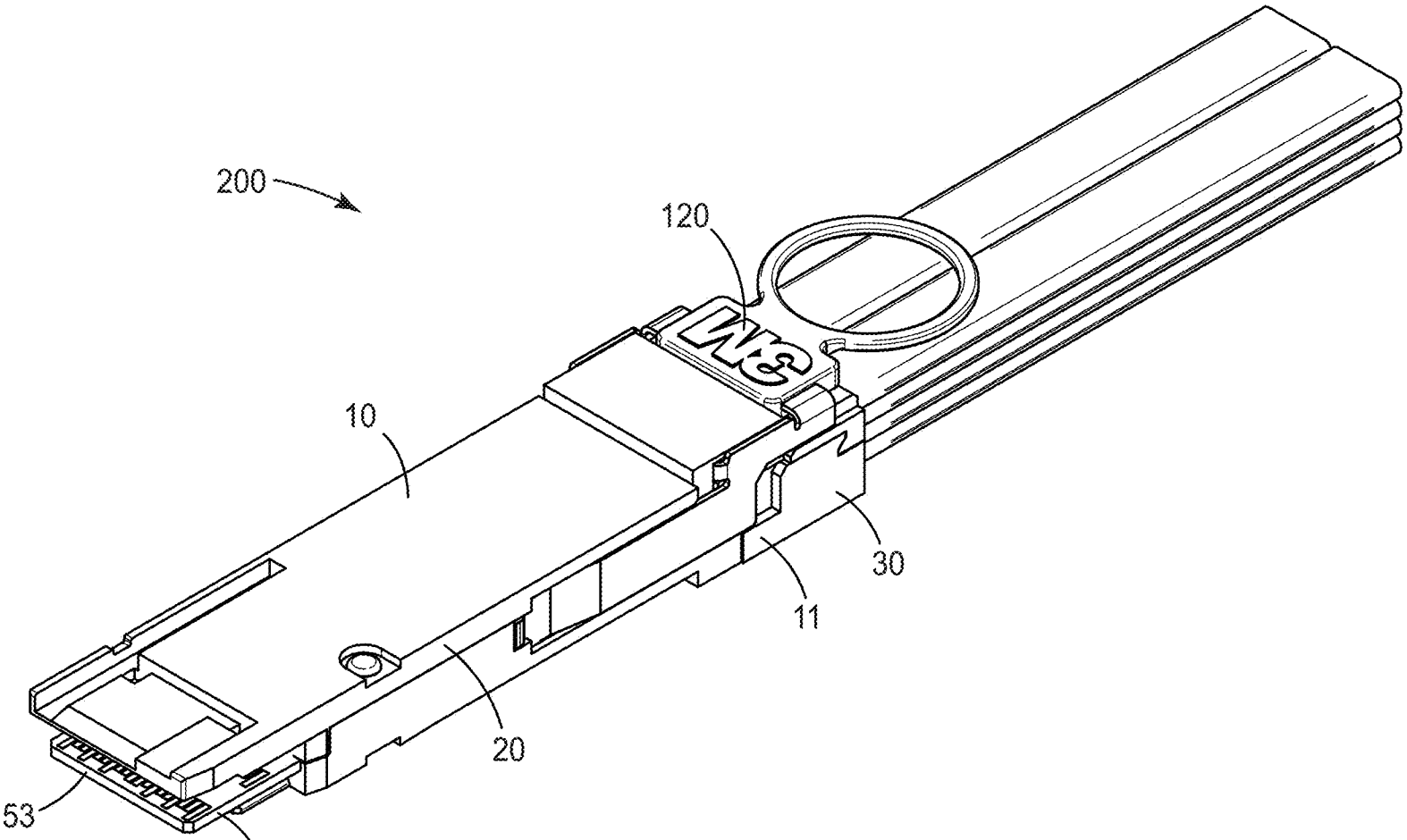
FIGS. 1 and 2 shows a schematic of a connector assembly according to an aspect of the disclosure.
Figure 2:
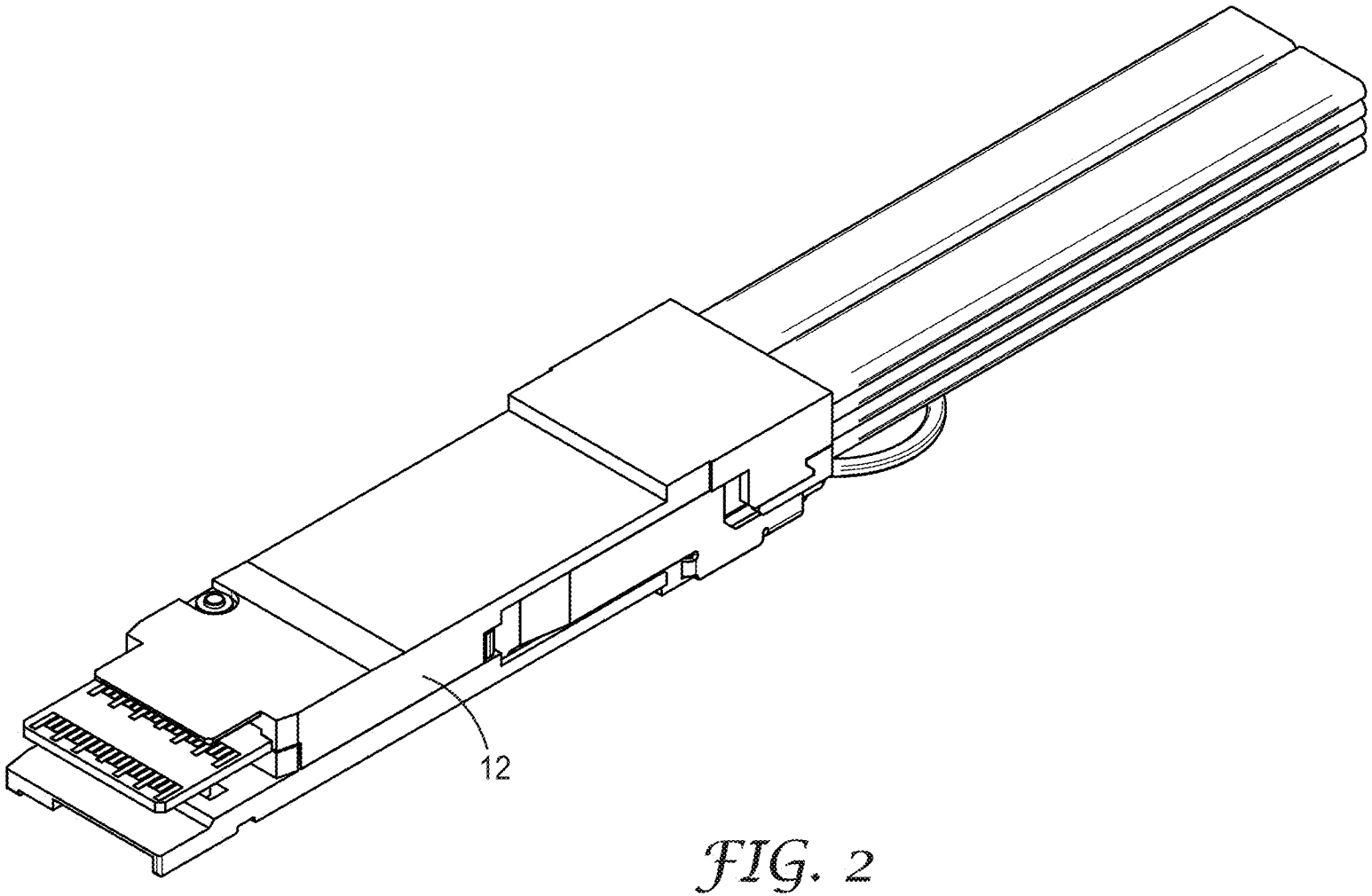
Figure 3:
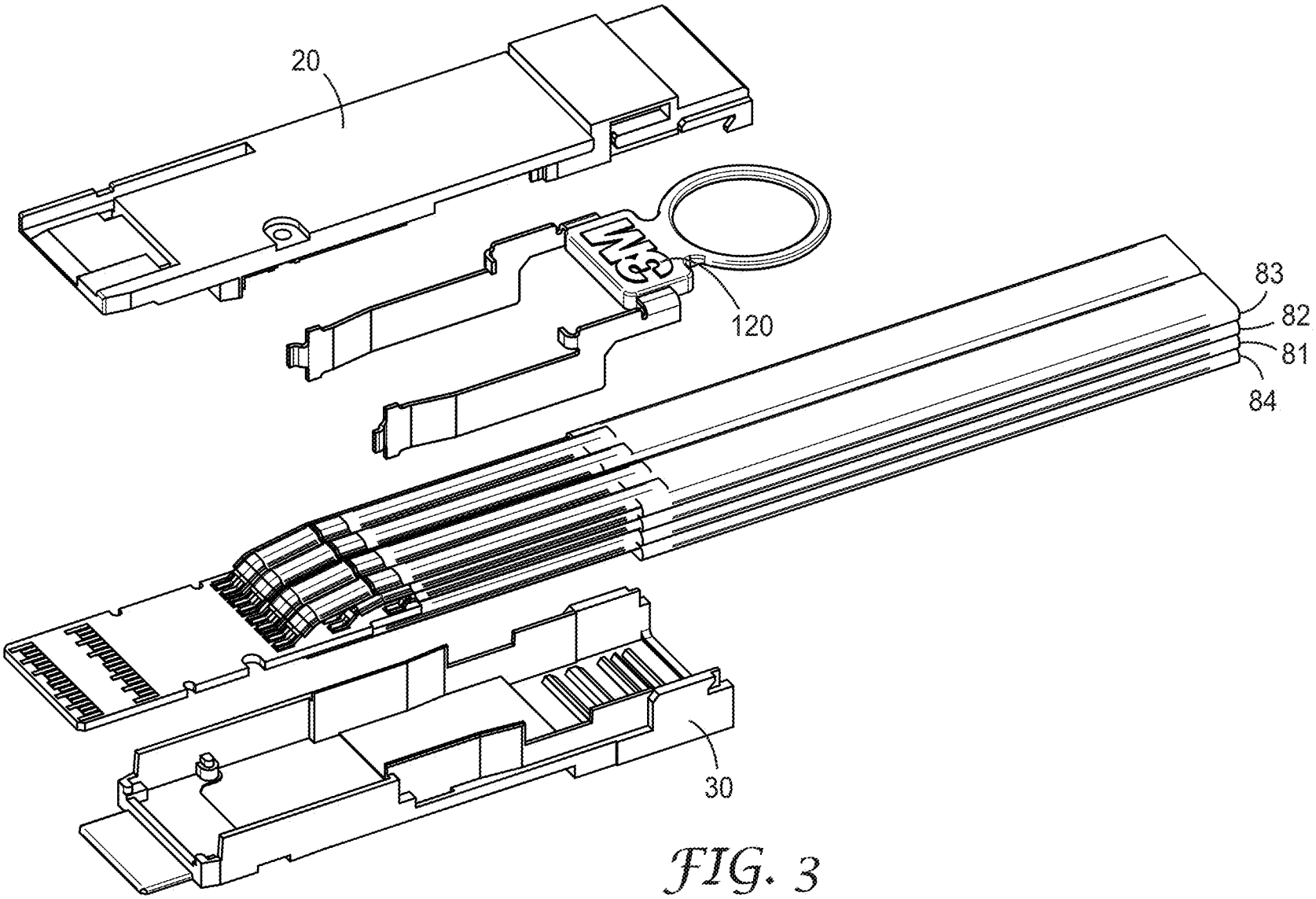
FIG. 3 shows an exploded view of the connector assembly.
Figure 4:
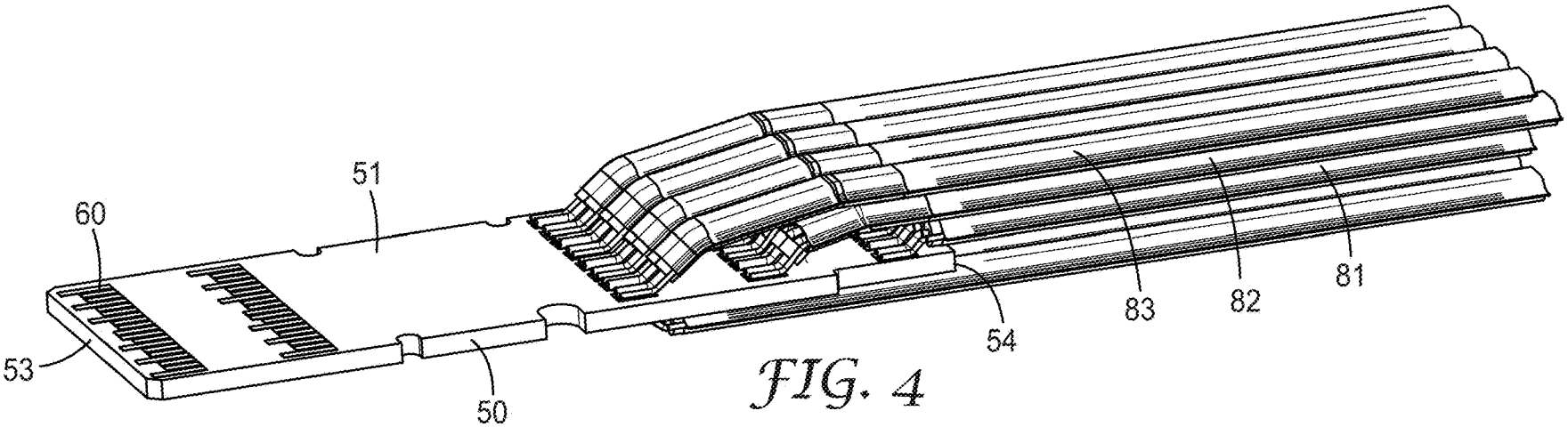
FIGS. 4 and 5 show the arrangement of the cables on the circuit board in accordance with an aspect of the disclosure.
Figure 5:
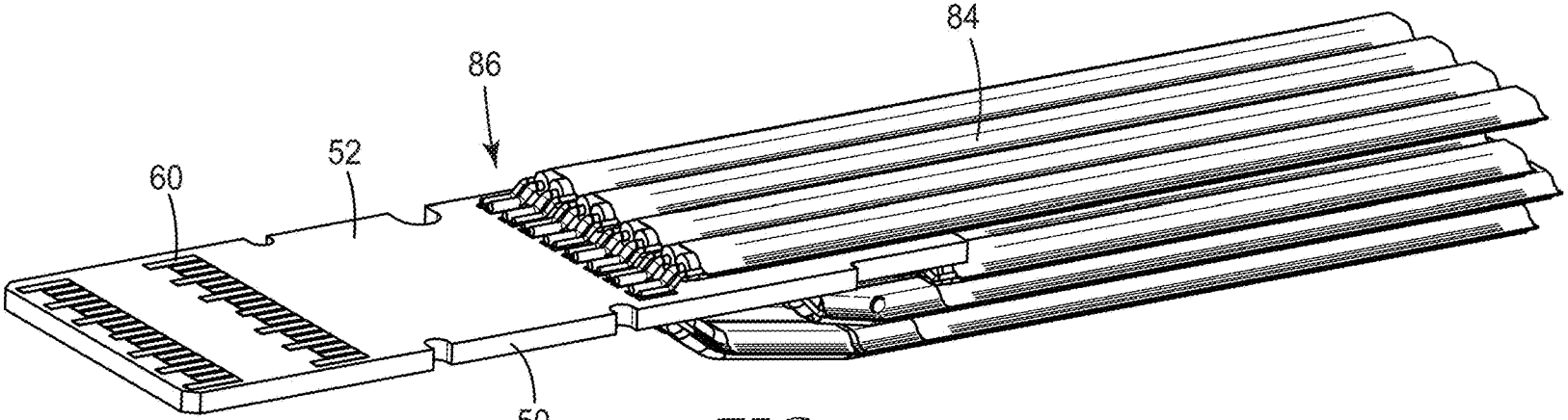
Figure 6:
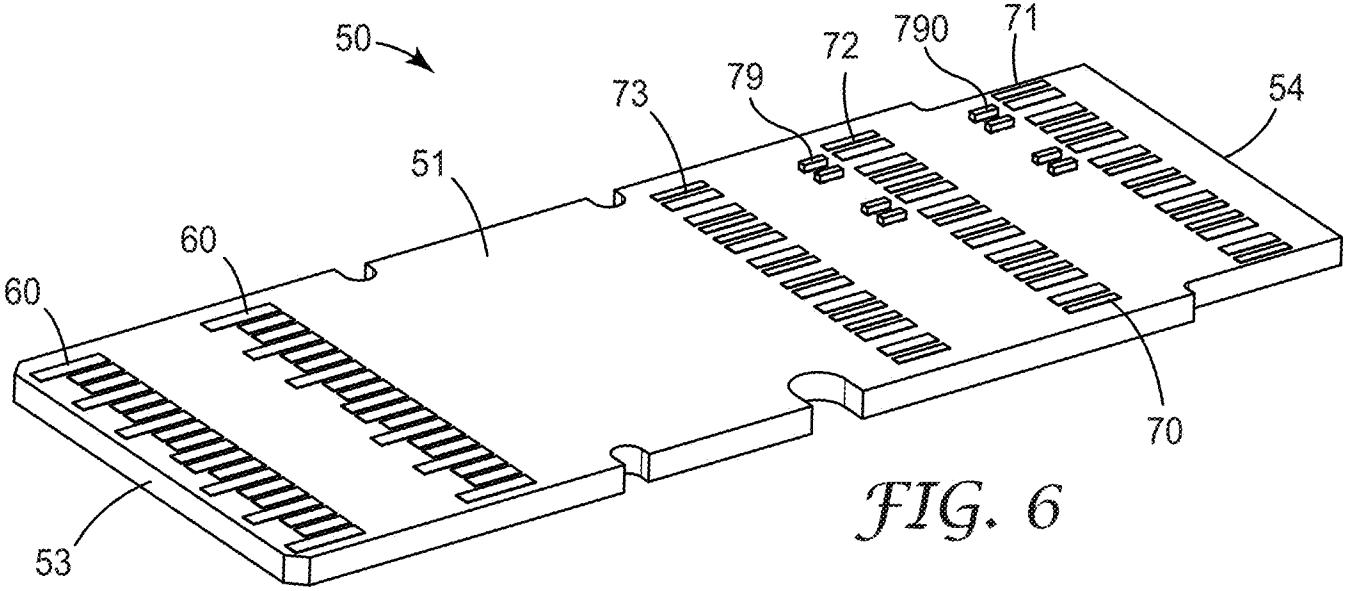
FIGS. 6 and 7 show the different views of the circuit board having a plurality of rows of rear pads according to an embodiment.
Figure 7:
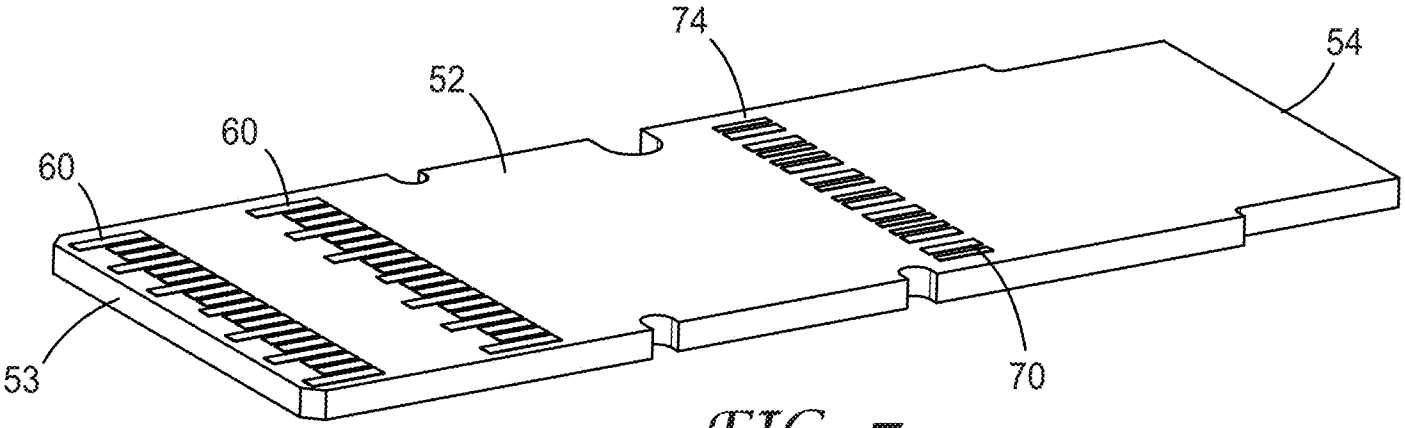
Figure 8:
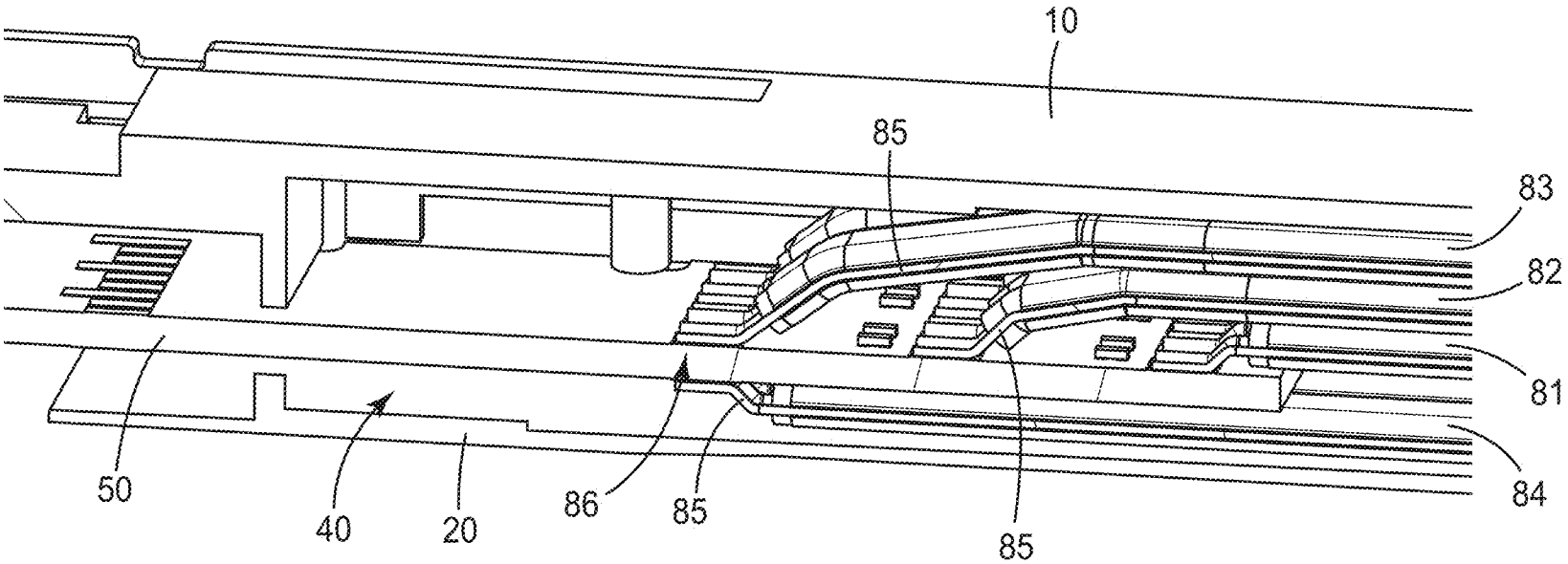
FIGS. 8 and 9 show details of the plurality of cables arranged on the circuit board.

As shown in FIGS. 1 to 9, the connector assembly (200) includes a housing (10) having top (20) and bottom (30) housing portions assembled to each other and defining a housing cavity (40) therebetween as can more clearly be seen in FIG. 8. The top and bottom housing portions (20, 30) may be made of metal. A circuit board (50) is disposed in the housing cavity (40). As shown in FIGS. 6 and 7 the circuit board (50) has an upper surface (51) and an opposing lower surface (52), a front edge (53) and a rear edge (54) opposite the front edge. One or more conductive front pads (60) are disposed on the upper and lower surfaces (51, 52) proximate the front edge (53). One or more conductive rear pads (70) are disposed on the upper and lower surfaces (51, 52) proximate the rear edge (54) and electrically connected to the front pads (60). In certain embodiments, the rear pads form first (71), second (72) and third (73) rows of rear pads disposed on the upper surface (51). A fourth row (74) of rear pads is disposed on the lower surface (52) of the circuit board (50). In some aspects, the second row (72) of rear pads is disposed between the first (71) and third (73) rows of rear pads. The first row (71) of rear pads is disposed closer to the rear edge (54) of the circuit board (50). The third row (73) of rear pads is disposed farther from the rear edge (54) of the circuit board (50). One or more capacitors (79) may be disposed between each row of rear pads.

As shown in FIGS. 4, 5 and 8, the connector assembly further includes first through fourth (81, 82, 83, 84) cables having a plurality of conductors (85). In some aspects, the first through fourth cables (81, 82, 83, 84) include a plurality of insulated conductors (87) as best seen in FIG. 13. Each insulated conductor (87) includes a conductor (85) surrounded by an insulating material (88). In certain embodiments, the conductor (85) has a diameter not greater than 24 American Wire Gauge (AWG). Further, in certain aspects, the first through fourth cables (81, 82, 83, 84) include a plurality of uninsulated drain conductors (89) as shown in FIG. 12.

Uninsulated front ends (86) of the conductors (85) of the first through fourth cables (81, 82, 83, 84) terminate at the corresponding rear pads of the first through fourth rows (71, 72, 73, 74) of the rear pads, respectively.

Figure 9:
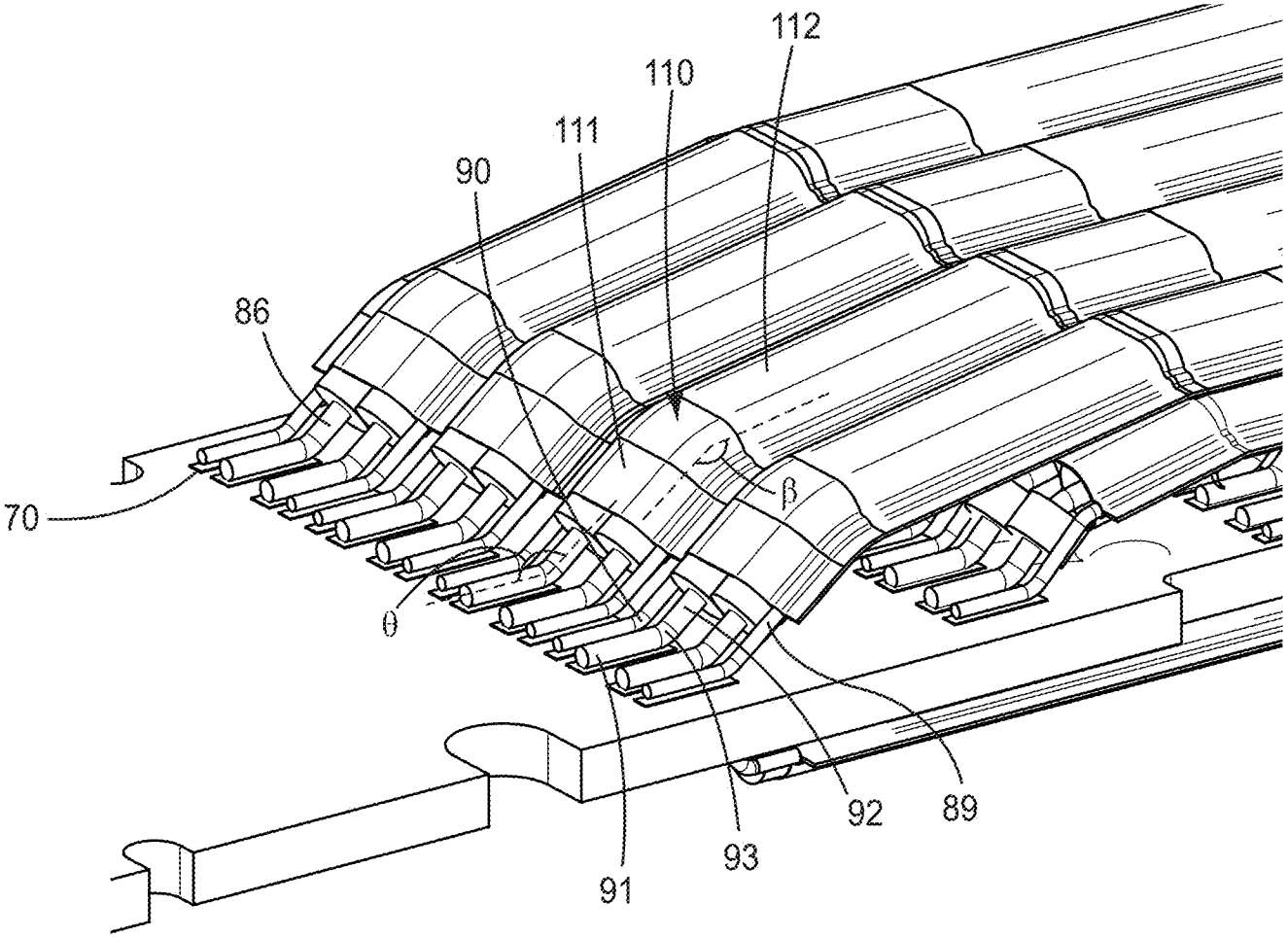
Figure 10:
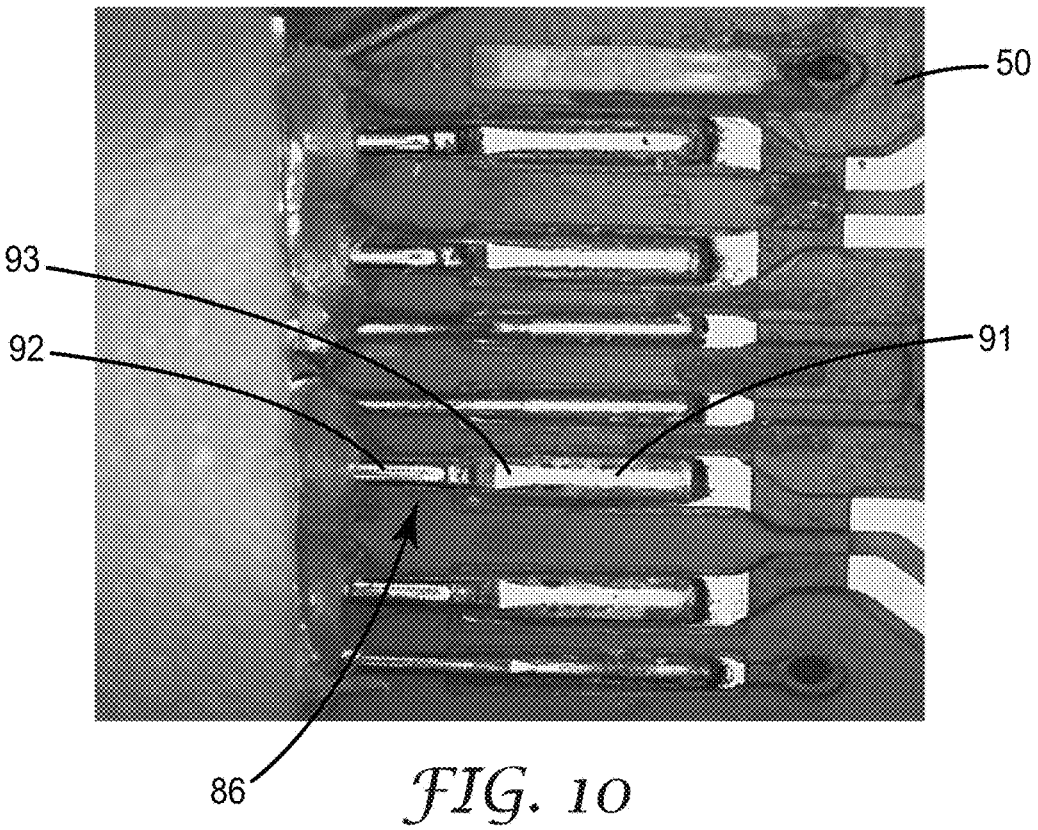
FIGS. 10 and 11 show a photograph of actual fabricated cables assembled on the circuit board.
Figure 11:
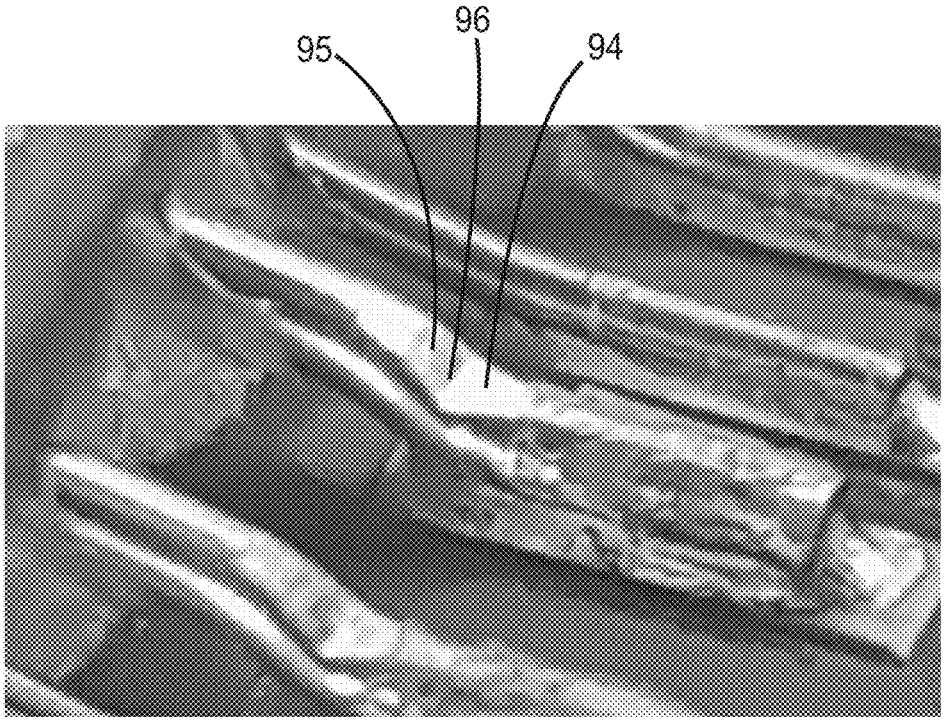

As shown in FIG. 9, the front end (86) of each conductor includes a first preformed bend (90) having substantially straight uninsulated first (91) and second (92) front end portions connected at a substantially flattened joint (93). The substantially flattened joint (93) has at least one substantially planar surface (94, 95) as shown in FIG. 11. The substantially planar surfaces (94, 95) may intersect each other along a substantially straight line (96). The first front end portion (91) is substantially parallel with and soldered to a corresponding rear pad (70). The second front end portion (92) makes a first angle (θ) with the first front end portion (91). According to an embodiment, the first angle (θ) is greater than about 90 degrees. In some cases, the first angle (θ) may be between 90-135 degrees. In some other cases, the first angle may be between 120 to 150 degrees, or between 150-170 degrees.

Figure 12:
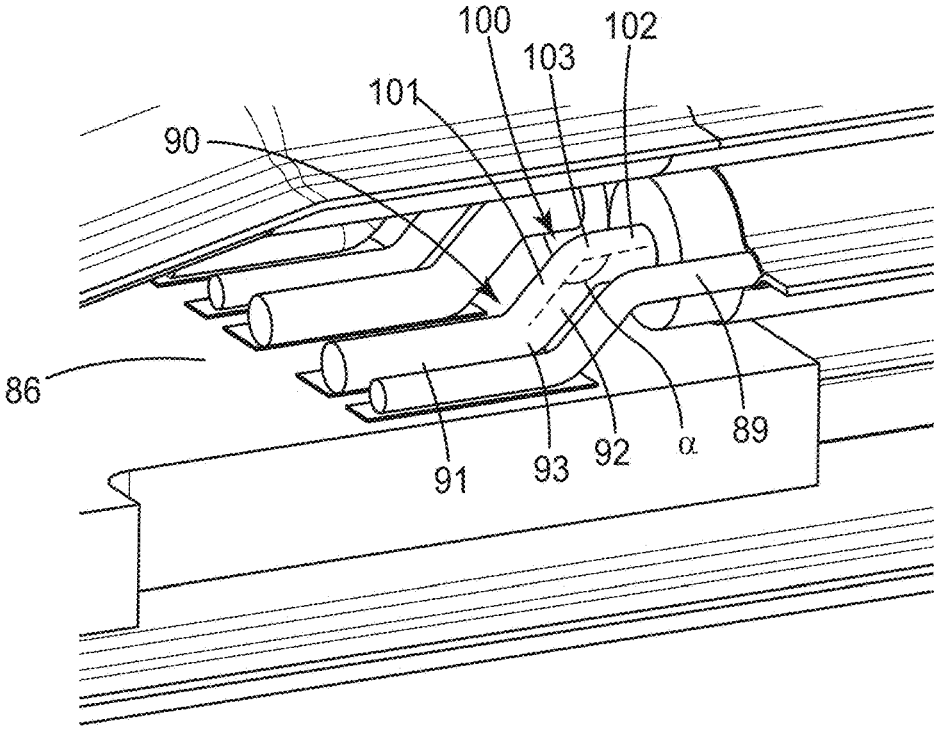
FIG. 12 shows details of one row of cables assembled to the circuit board according to an aspect of the disclosure.
Figure 13:
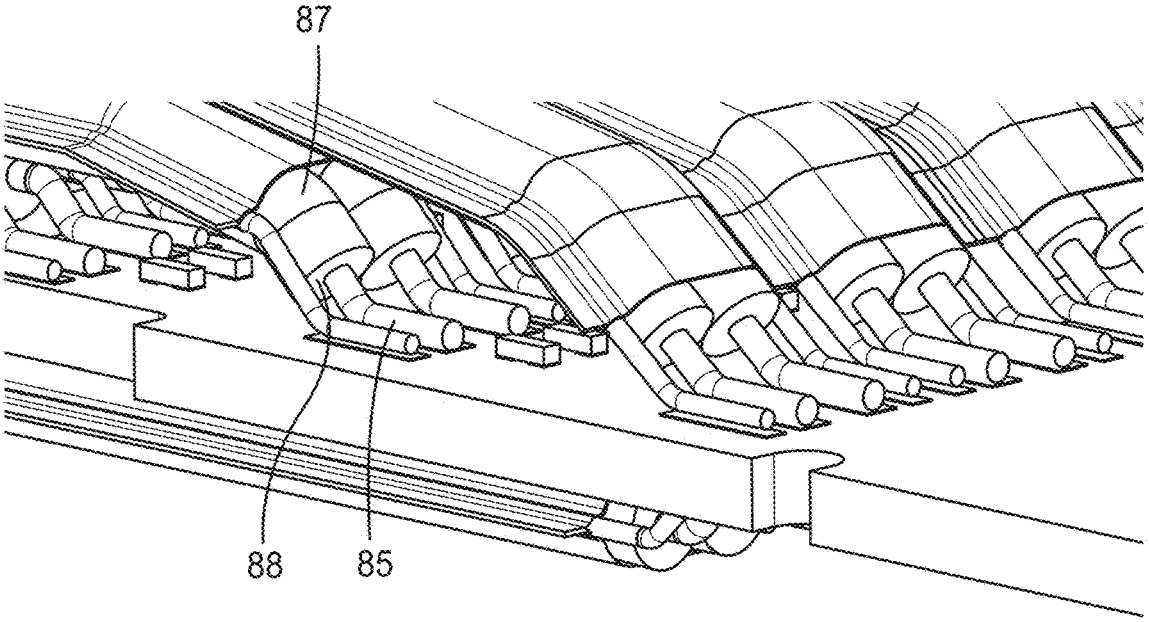
FIG. 13 shows details of an insulated connector having a conductor and insulating material according to an aspect of the disclosure.

In an embodiment as best shown in FIG. 12, the uninsulated front end (86) of at least one conductor of at least one cable includes a second preformed bend (100). The second preformed bend (100) includes substantially straight uninsulated first (101) and second (102) front end portions connected at a substantially flattened joint (103). The first and second front end portions (101, 102) make a second angle (α) therebetween greater than about 90 degrees. In some cases, the second angle (α) may be between 90-135 degrees. In some other cases, the second angle (α) may be between 120 to 150 degrees, or between 150-170 degrees.

As shown in FIG. 9, an insulated portion adjacent to the uninsulated front end (86) of at least one conductor of at least one cable includes an insulated preformed bend (110) having substantially straight insulated first (111) and second (112) portions. The first and second insulated portions (111, 112) make a third angle (β) therebetween greater than about 90 degrees. In some cases, the third angle (β) may be between 90-135 degrees. In some other cases, the third angle (β) may be between 120 to 150 degrees, or between 150-170 degrees.

Figure 14:
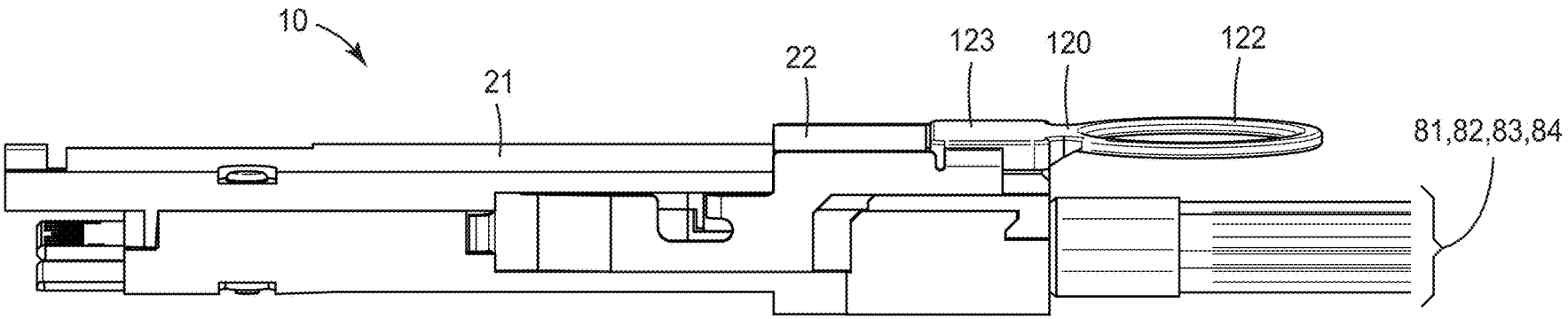
FIGS. 14-16 show different views of the connector assembly illustrating the pull tab according to an aspect of the disclosure.
Figure 15:
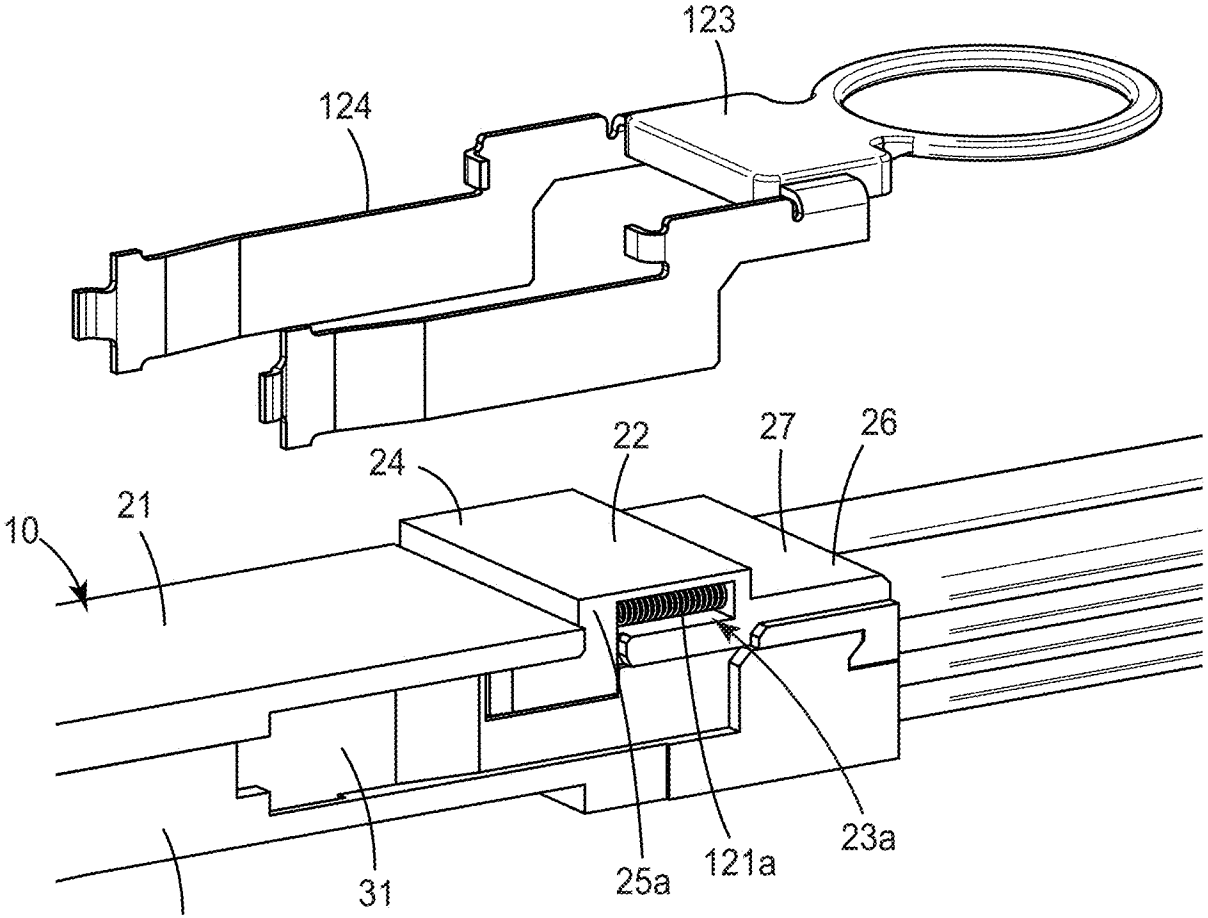
Figure 16:
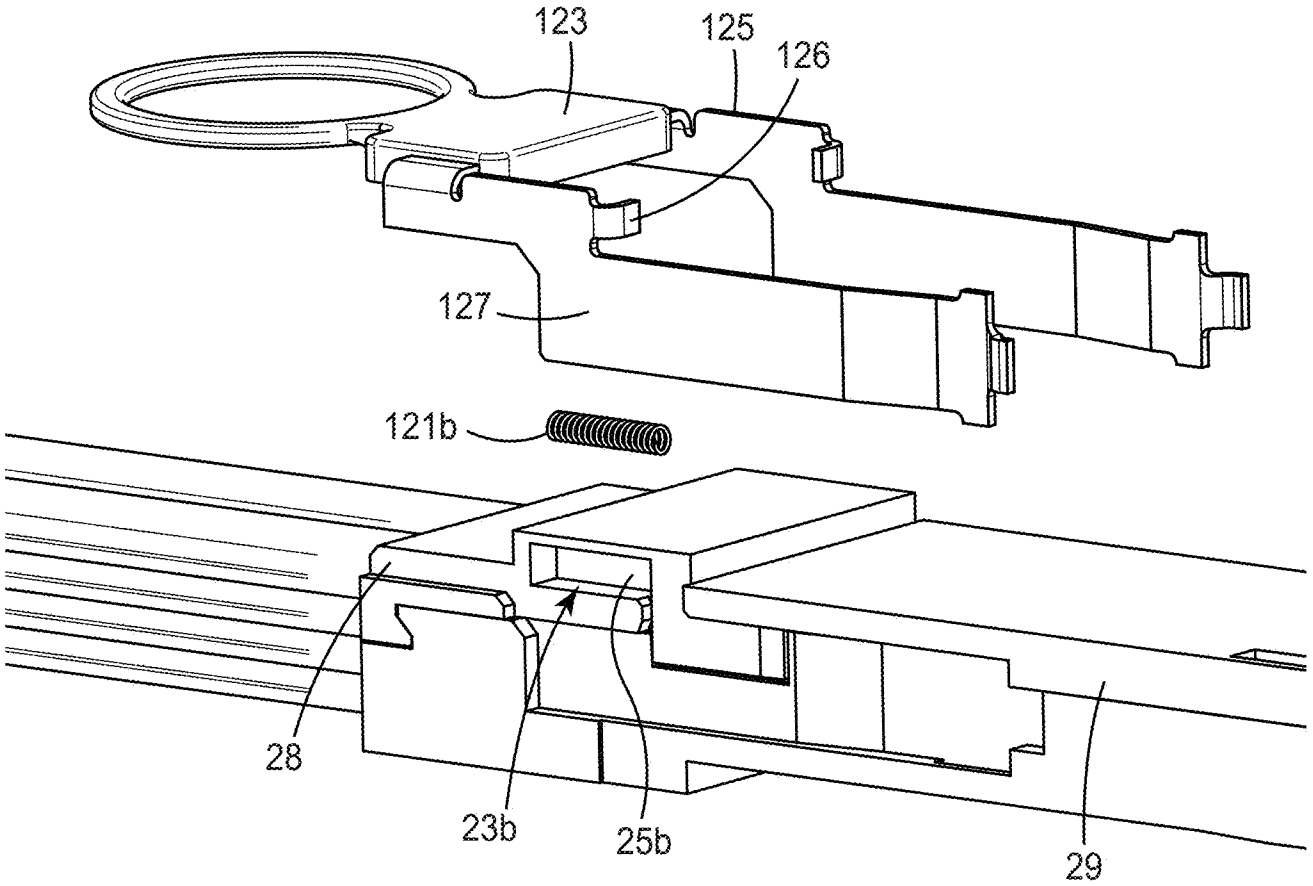

In an embodiment as shown in FIGS. 14-16, the top housing portion (20) includes a front portion (21), a middle portion (22) and a back portion (26). The front portion (21) extends from the middle portion (22), the middle portion (22) being disposed between the front portion and the back portion and elevated relative to the front portion (21). The middle portion defines a first recess (23*a*, 23*b*) formed in an external surface (24). On each lateral side (25*a*, 25*b*) of the middle portion, each first recess (23*a*, 23*b*) is configured to receive and house a spring member (121*a*, 121*b*) of a pull tab (120) assembled to the housing. As shown in the side plan view (FIG. 14) an operating portion (122) of the pull tab (120) extends backwardly from the middle portion (22) and further extends behind and beyond the housing (10) and is oriented to be above the first through fourth cables (81, 82, 93, 84). In this position, when the pull tab (120) is assembled to the housing and the spring members (121*a*, 121*b*) of the pull tab are disposed in the first recesses (23*a*, 23*b*), the spring members (121*a*, 121*b*) are above the first through fourth cables. In some aspects, as shown in FIG. 15, when the pull tab (120) is assembled to the housing (10), a middle portion (123) of the pull tab rests on, and is configured to slide back and forth against and relative to, a top surface of the top housing portion (20). In some embodiments, the pull tab rests on, and is configured to slide back and forth against and relative to, a top surface (27) of the back portion (26).

The pull tab (120) includes opposing actuating portions (124) disposed on, and extending longitudinally along, opposing lateral sides (11, 12) of the housing. Each actuating portion (124) includes a first arm (125) and a second arm (127). The first arm (125) is disposed primarily in a corresponding external cutout (28) in a lateral side (29) of the top housing portion (20) as shown in FIG. 16. The first arm (125) terminates in a bias portion (126) bending inwardly toward the other actuating portion (124). The second arm (127) is substantially parallel to, and longer than and vertically offset relative to, the first arm (125). The second arm (127) is disposed primarily in a corresponding external cutout (31) in a lateral side (32) of the bottom housing portion as best seen in FIG. 15.

Figure 17:
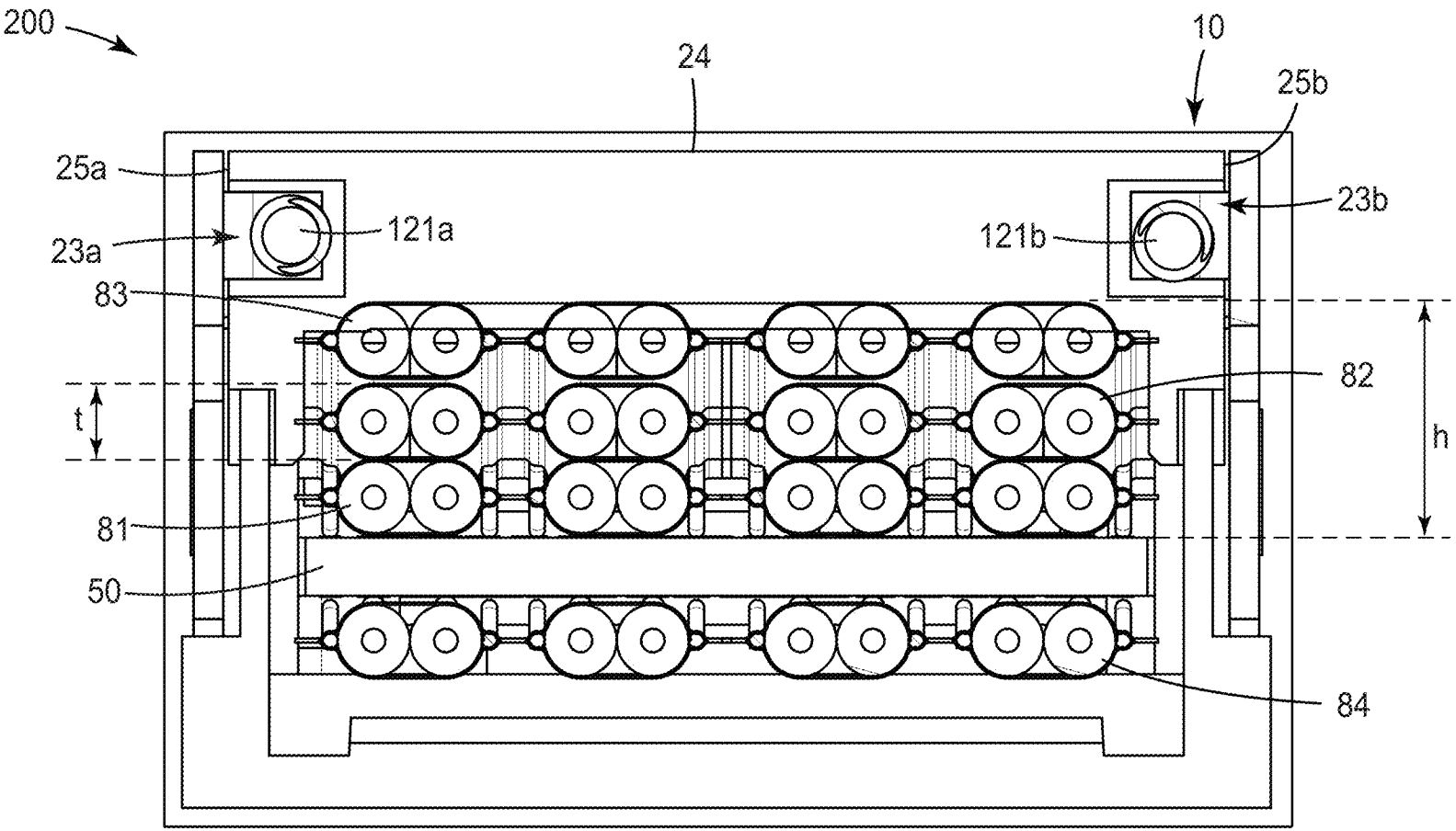
FIG. 17 shows a cross section view of the connector assembly illustrating the arrangement of the cable and spring back function within the width of the metal shell.

As shown in FIG. 17, in some embodiments, where an average thickness of the cable is t, a vertical separation h between the recess (23*a*, 23*b*) and the circuit board (50) is such that $h \geq 3t$.

In some cases, the conductor has a diameter not greater than 24 American Wire Gauge (AWG). In some other cases, the conductor has a diameter not greater than 22 AWG, and in some other cases, the conductor has a diameter not greater than 20 AWG.

Embodiments disclosed herein include:

Embodiment 1. A connector assembly, including: a housing including top and bottom housing portions assembled to each other and defining a housing cavity therebetween; a circuit board disposed in the housing cavity and including: an upper surface and an opposing lower surface; a front edge and a rear edge opposite the front edge; a plurality of conductive front pads disposed on the upper and lower surfaces proximate the front edge; and a plurality of conductive rear pads disposed on the upper and lower surfaces proximate the rear edge and electrically connected to the front pads, the rear pads forming first, second and third rows of rear pads disposed on the upper surface and a fourth row of rear pads disposed on the lower surface, the second row of rear pads disposed between the first and third rows of rear pads, the first and third rows of rear pads disposed respectively closer to and farther from the rear edge of the circuit board; first through fourth cables including a plurality of conductors, uninsulated front ends of the conductors of the first through fourth cables terminated at the corresponding rear pads of the first through fourth rows of the rear pads, respectively, the front end of each conductor including a first preformed bend including substantially straight uninsulated first and second front end portions connected at a substantially flattened joint, the first front end portion substantially parallel with and soldered to a corresponding rear pad, the second front end portion making a first angle with the first front end portion greater than about 90 degrees.

Embodiment 2. The connector assembly of embodiment 1 wherein the substantially flattened joint includes at least one substantially planar surface.

Embodiment 3. The connector assembly of embodiment 1, wherein the substantially flattened joint includes first and second substantially planar surfaces intersecting each other along a substantially straight line.

Embodiment 4. The connector assembly of embodiment 1, wherein the uninsulated front end of at least one conductor of at least one cable further includes a second preformed bend including substantially straight uninsulated first and second front end portions connected at a substantially flattened joint, the first and second front end portions making a second angle therebetween greater than about 90 degrees.

Embodiment 5. The connector assembly of embodiment 1, wherein an insulated portion, adjacent to the uninsulated front end, of at least one conductor of at least one cable includes an insulated preformed bend including substantially straight insulated first and second portions making a third angle therebetween greater than about 90 degrees.

Embodiment 6. The connector assembly of embodiment 1, wherein the conductors in the plurality of conductors of the first through fourth cables have diameters not greater than 24 American Wire Gauge (AWG).

Embodiment 7. The connector assembly of embodiment 1, wherein the first through fourth cables include a plurality of insulated conductors, each insulated conductor including a conductor surrounded by an insulating material, the conductor having a diameter not greater than 24 American Wire Gauge (AWG).

Embodiment 8. The connector assembly of embodiment 1, wherein the first through fourth cables include a plurality of uninsulated drain conductors.

Embodiment 9. The connector assembly of embodiment 1, wherein the top housing portion includes a front portion extending from a middle portion elevated relative to the front portion, the middle portion defining a first recess formed in an external surface, and on each lateral side, of the middle portion, each first recess configured to receive and house a spring member of a pull tab assembled to the housing, such that when the pull tab is assembled to the housing and the spring members of the pull tab are disposed in the first recesses, in a side plan view with an operating portion of the pull tab extending behind and beyond the housing and oriented to be above the first through fourth cables, the spring members are above the first through fourth cables.

Embodiment 10. The connector assembly of embodiment 1, wherein the top housing portion includes a middle portion disposed between, and elevated relative to, a front portion and a back portion, such that when a pull tab is assembled to the housing, a portion of the pull tab rests on, and is configured to slide back and forth against and relative to, a top surface of the back portion.

Embodiment 11. The connector assembly of embodiment 1 further including a pull tab assembled to the housing, the pull tab including: a middle portion resting on, and configured to slide back and forth against and relative to, a top surface of the top housing portion; an operating portion extending backwardly from the middle portion behind and beyond the housing; and opposing actuating portions disposed on, and extending longitudinally along, opposing lateral sides of the housing, each actuating portion including: a first arm disposed primarily in a corresponding external cutout in a lateral side of the top housing portion and terminating in a bias portion bending inwardly toward the other actuating portion; and a second arm substantially parallel to, and longer than and vertically offset relative to, the first arm and disposed primarily in a corresponding external cutout in a lateral side of the bottom housing portion.

Embodiment 12. The connector assembly of embodiment 1, wherein the top and bottom housing portions are made of metal.

Embodiment 13. The connector assembly of embodiment 1 being a quad small form-factor pluggable (QSFP) connector assembly.

Embodiment 14. The connector assembly of embodiment 1 being a quad small form-factor pluggable double density (QSFP-DD) connector assembly.

Embodiment 15. A connector assembly, including: a housing; a circuit board disposed in the housing and including a conductive front pad proximate a front edge of the circuit board, and a conductive rear pad disposed proximate an opposite rear edge of the circuit board and electrically connected to the front pad; a cable including an insulated conductor including a conductor surrounded by an insulating material, an uninsulated front end of the conductor terminated at the rear pad and including a first preformed bend including substantially straight uninsulated first and second front end portions connected at a substantially flattened joint, the first front end portion substantially parallel with and soldered to the rear pad, the second front end portion making a first angle with the first front end portion greater than about 90 degrees; and a recess formed in an external surface, and on a lateral side, of the housing, the recess configured to receive and house a spring member of a pull tab assembled to the housing, a vertical separation between the recess and the circuit board being h, an average thickness of the cable being t, $h \geq 3t$.

Embodiment 16. The connector assembly of embodiment 15 being a quad small form-factor pluggable double density (QSFP-DD) connector assembly.

Embodiment 17. The connector assembly of embodiment 15, wherein the conductor has a diameter not greater than 24 American Wire Gauge (AWG).

Embodiment 18. The connector assembly of embodiment 15, wherein the conductor has a diameter not greater than 22 American Wire Gauge (AWG).

Embodiment 19. The connector assembly of embodiment 15, wherein the conductor has a diameter not greater than 20 American Wire Gauge (AWG).

Embodiment 20. The connector assembly of embodiment 15, wherein the housing includes top and bottom housing portions assembled to each other and defining a housing cavity therebetween, and wherein the circuit board is disposed in the housing cavity.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific Embodiments shown and described without departing from the scope of the present disclosure. This application is intended to cover any adaptations or variations of the specific Embodiments discussed herein. Therefore, it is intended that this disclosure be limited only by the claims and the equivalents thereof.

The invention claimed is:

1. A connector assembly, comprising:

a housing comprising top and bottom housing portions assembled to each other and defining a housing cavity therebetween;

a circuit board disposed in the housing cavity and comprising:

an upper surface and an opposing lower surface;

a front edge and a rear edge opposite the front edge;

a plurality of conductive front pads disposed on the upper and lower surfaces proximate the front edge; and a plurality of conductive rear pads disposed on the upper and lower surfaces proximate the rear edge and electrically connected to the front pads, the rear pads forming first, second and third rows of rear pads disposed on the upper surface and a fourth row of rear pads disposed on the lower surface, the second row of rear pads disposed between the first and third rows of rear pads, the first and third rows of rear pads disposed respectively closer to and farther from the rear edge of the circuit board;

first through fourth cables comprising a plurality of conductors, uninsulated front ends of the conductors of the first through fourth cables terminated at the corresponding rear pads of the first through fourth rows of the rear pads, respectively, the front end of each conductor comprising a first preformed bend comprising substantially straight uninsulated first and second front end portions connected at a substantially flattened joint, the first front end portion substantially parallel with and soldered to a corresponding rear pad, the second front end portion making a first angle with the first front end portion greater than about 90 degrees.

2. The connector assembly of claim 1, wherein the substantially flattened joint comprises at least one substantially planar surface.

3. The connector assembly of claim 1, wherein the substantially flattened joint comprises first and second substantially planar surfaces intersecting each other along a substantially straight line.

4. The connector assembly of claim 1, wherein the uninsulated front end of at least one conductor of at least one cable further comprises a second preformed bend comprising substantially straight uninsulated first and second front end portions connected at a substantially flattened joint, the first and second front end portions making a second angle therebetween greater than about 90 degrees.

5. The connector assembly of claim 1, wherein an insulated portion, adjacent to the uninsulated front end, of at least one conductor of at least one cable comprises an insulated preformed bend comprising substantially straight insulated first and second portions making a third angle therebetween greater than about 90 degrees.

6. The connector assembly of claim 1, wherein the conductors in the plurality of conductors of the first through fourth cables have diameters not greater than 24 American Wire Gauge (AWG).

7. The connector assembly of claim 1, wherein the first through fourth cables comprise a plurality of insulated conductors, each insulated conductor comprising a conductor surrounded by an insulating material, the conductor having a diameter not greater than 24 American Wire Gauge (AWG).

8. The connector assembly of claim 1, wherein the first through fourth cables comprise a plurality of uninsulated drain conductors.

9. The connector assembly of claim 1, wherein the top housing portion comprises a front portion extending from a middle portion elevated relative to the front portion, the middle portion defining a first recess formed in an external surface, and on each lateral side, of the middle portion, each first recess configured to receive and house a spring member of a pull tab assembled to the housing, such that when the pull tab is assembled to the housing and the spring members of the pull tab are disposed in the first recesses, in a side plan view with an operating portion of the pull tab extending behind and beyond the housing and oriented to be above the first through fourth cables, the spring members are above the first through fourth cables.

10. The connector assembly of claim 1, wherein the top housing portion comprises a middle portion disposed between, and elevated relative to, a front portion and a back portion, such that when a pull tab is assembled to the housing, a portion of the pull tab rests on, and is configured to slide back and forth against and relative to, a top surface of the back portion.

11. The connector assembly of claim 1 further comprising a pull tab assembled to the housing, the pull tab comprising:

a middle portion resting on, and configured to slide back and forth against and relative to, a top surface of the top housing portion;

an operating portion extending backwardly from the middle portion behind and beyond the housing; and opposing actuating portions disposed on, and extending longitudinally along, opposing lateral sides of the housing, each actuating portion comprising:

a first arm disposed primarily in a corresponding external cutout in a lateral side of the top housing portion and terminating in a bias portion bending inwardly toward the other actuating portion; and a second arm substantially parallel to, and longer than and vertically offset relative to, the first arm and disposed primarily in a corresponding external cutout in a lateral side of the bottom housing portion.

12. The connector assembly of claim 1, wherein the top and bottom housing portions are made of metal.

13. The connector assembly of claim 1 being a quad small form-factor pluggable (QSFP) connector assembly.

14. The connector assembly of claim 1 being a quad small form-factor pluggable double density (QSFP-DD) connector assembly.

15. A connector assembly, comprising:

a housing;

a circuit board disposed in the housing and comprising a conductive front pad proximate a front edge of the circuit board, and a conductive rear pad disposed proximate an opposite rear edge of the circuit board and electrically connected to the front pad;

a cable comprising an insulated conductor comprising a conductor surrounded by an insulating material, an uninsulated front end of the conductor terminated at the rear pad and comprising a first preformed bend comprising substantially straight uninsulated first and second front end portions connected at a substantially flattened joint, the first front end portion substantially parallel with and soldered to the rear pad, the second front end portion making a first angle with the first front end portion greater than about 90 degrees; and a recess formed in an external surface, and on a lateral side, of the housing, the recess configured to receive and house a spring member of a pull tab assembled to the housing, a vertical separation between the recess and the circuit board being h, an average thickness of the cable being t, $h \geq 3t$.

16. The connector assembly of claim 15 being a quad small form-factor pluggable double density (QSFP-DD) connector assembly.

17. The connector assembly of claim 15, wherein the conductor has a diameter not greater than 24 American Wire Gauge (AWG).

18. The connector assembly of claim 15, wherein the conductor has a diameter not greater than 22 American Wire Gauge (AWG).

19. The connector assembly of claim 15, wherein the conductor has a diameter not greater than 20 American Wire Gauge (AWG).

20. The connector assembly of claim 15, wherein the housing comprises top and bottom housing portions assembled to each other and defining a housing cavity therebetween, and wherein the circuit board is disposed in the housing cavity.

* * * * *